US006705296B2

(12) United States Patent
Horstmann et al.

(10) Patent No.: US 6,705,296 B2
(45) Date of Patent: Mar. 16, 2004

(54) METHOD AND DEVICE FOR CALIBRATING A PRESSURE SENSOR IN A FUEL METERING SYSTEM

(75) Inventors: Peter Horstmann, Sindelfingen (DE); Juergen Hammer, Fellbach (DE)

(73) Assignee: Robert Bosch GmbH, Stuttgart (DE)

( * ) Notice: Subject to any disclaimer, the term of this patent is extended or adjusted under 35 U.S.C. 154(b) by 57 days.

(21) Appl. No.: 10/069,213

(22) PCT Filed: Jun. 16, 2001

(86) PCT No.: PCT/DE01/02242

§ 371 (c)(1),
(2), (4) Date: Jul. 8, 2002

(87) PCT Pub. No.: WO02/01057

PCT Pub. Date: Jan. 3, 2002

(65) Prior Publication Data

US 2002/0170542 A1 Nov. 21, 2002

(30) Foreign Application Priority Data

Jun. 24, 2000 (DE) ..... 100 30 935

(51) Int. Cl.[7] ..... F02M 1/500
(52) U.S. Cl. ..... 123/494; 73/118.1
(58) Field of Search ..... 123/488, 494, 123/198 D; 73/118.1, 115, 116

(56) References Cited

U.S. PATENT DOCUMENTS 6,012,438 A * 1/2000 Joos et al. ..... 123/690
6,038,912 A * 3/2000 Isobe et al. ..... 73/1.59
6,252,503 B1 * 6/2001 Berger et al. ..... 340/514
6,505,505 B1 * 1/2003 Henzinger et al. ..... 73/118.2

FOREIGN PATENT DOCUMENTS

| | | |
|---|---|---|
| DE | 195 47 647 | 6/1997 |
| EP | 0 916 831 | 5/1999 |
| EP | 0 976 921 | 2/2000 |
| JP | 55 162536 | 12/1980 |

* cited by examiner

*Primary Examiner*—Mahmoud Gimie
(74) *Attorney, Agent, or Firm*—Kenyon & Kenyon

(57) ABSTRACT

A method for calibrating a pressure sensor in a fuel metering system and a corresponding device, which enable the pressure sensor to be calibrated as precisely as possible. For this purpose, the instantaneous cooling-water temperature of the internal combustion engine is measured and the drop in the cooling-water temperature is derived therefrom as a measure for the standstill time of the internal combustion engine, the pressure sensor first being calibrated when the standstill time exceeds a predefinable minimum. Thus, an arrangement for monitoring the cooling-water temperature already present per se in the vehicle may be used to reliably and precisely calibrate the pressure sensor. Therefore, this is able to be realized very quickly and almost without extra expenses, in particular without using an additional timing supervision for measuring the standstill time. The method and the corresponding device are well suited for calibrating pressure sensors in the high-pressure region (rail pressure sensors) as well as for calibrating sensors in the low-pressure region (presupply pressure sensors).

8 Claims, 1 Drawing Sheet

METHOD AND DEVICE FOR CALIBRATING A PRESSURE SENSOR IN A FUEL METERING SYSTEM

FIELD OF THE INVENTION

Figure 1:
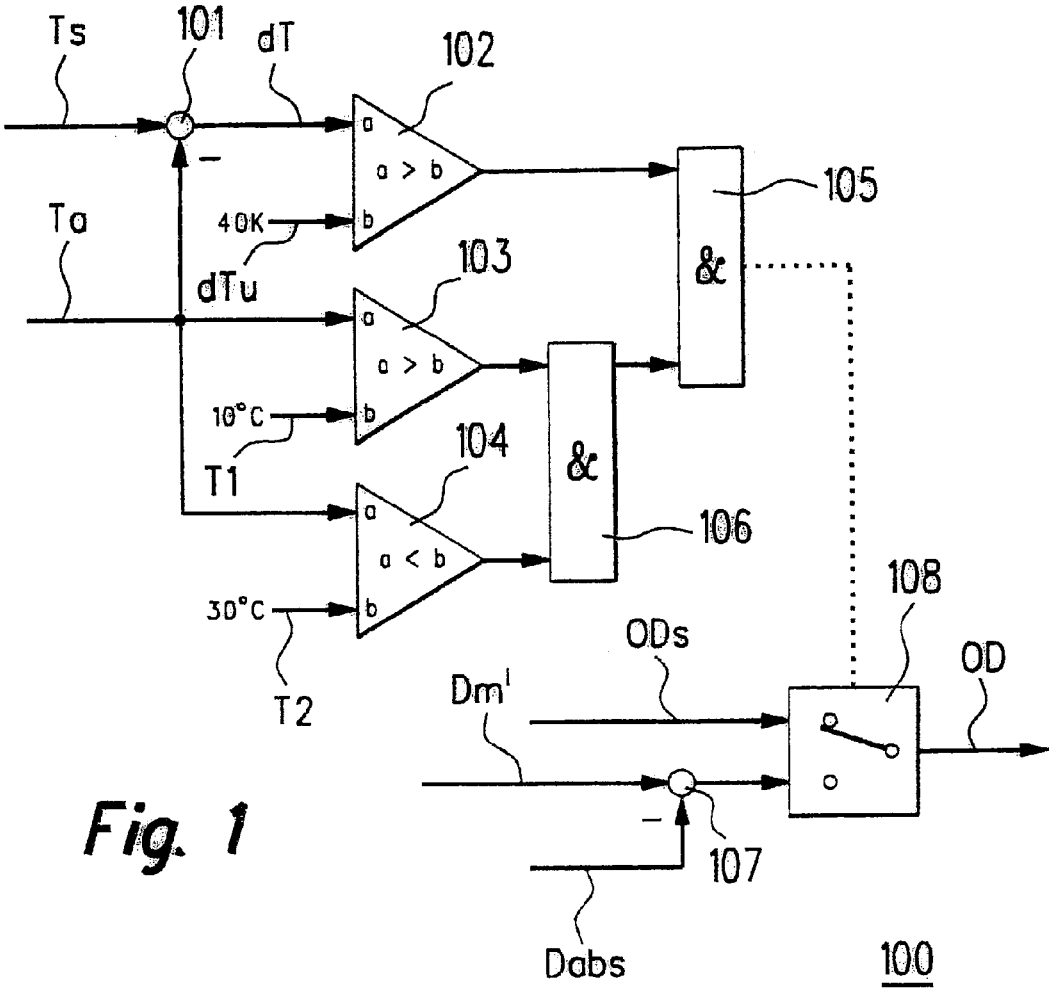

The present invention relates to a method for calibrating a pressure sensor in a fuel metering system as well as to a device for implementing the method, a control element equipped with the device, and a fuel metering system.

BACKGROUND INFORMATION

Conventional methods and devices exist for calibrating a pressure sensor of a fuel metering system of an internal combustion engine. A fuel metering system may be equipped with a high-pressure pump for transporting fuel from a low-pressure region to a high-pressure region, with injectors, which are controllable as a function of performance quantities, for metering and injecting fuel into the combustion chambers of the internal combustion engine, as well as with at least one pressure sensor for measuring the pressure in the high-pressure region and/or low-pressure region. Fuel metering systems are known, e.g. as so-called common-rail direct fuel-injection systems.

These systems are equipped with a presupply pump and a demand-controlled high-pressure pump. For example, an electric fuel pump, which transports the fuel from a fuel reservoir to the low-pressure region of the system, is used as the presupply pump. In the low-pressure region, there is an admission pressure of about 4 bar. The high-pressure pump transports the fuel from the low-pressure region to a high-pressure accumulator of the system. A significantly higher pressure prevails there, namely a pressure of about 150 to 200 bar in the case of gasoline and a pressure of about 1500 to 2000 bar in the case of diesel fuel. A plurality of injectors, which, in response to being accordingly activated, inject the fuel from the high-pressure accumulator into the combustion chambers of the internal combustion engine at the injection pressure in the high-pressure accumulator, branch off from the high-pressure accumulator. The injectors are controllable as a function of certain operating parameters. Situated in the high-pressure accumulator is a pressure sensor, a so-called rail pressure sensor, which is used to determine the injection pressure prevailing in the high-pressure accumulator and is then used to direct an appropriate electrical signal to a control unit of the internal combustion engine. A pressure control line branches off from the high-pressure region and leads via a pressure control valve into the low-pressure region. A pressure sensor, a so-called presupply pressure sensor, may also be provided there. A low-pressure line branches off from the low-pressure region and leads via a low-pressure regulator back into the fuel reservoir.

Pressure sensors in general, as well as the pressure sensors in the abovementioned fuel metering systems, have a static offset error, i.e., the zero point is not reliably indicated. However, as a result of an offset error, the measured value of the pressure sensors, in particular the measured value acquired by the pressure sensors in the low-pressure region, may deviate significantly from the actual pressure value.

In the starting phase of direct injection common-rail internal combustion engines, there is typically a low pressure. The internal combustion engine is usually started with a low admission pressure generated by the presupply pump and is not switched to the high pressure until later. Since the fuel quantity injected into the combustion chambers by the injectors is particularly dependent on the injection pressure prevailing in the high-pressure accumulator, this injection pressure should be included in the calculation of the injection time in the starting phase of the internal combustion engine. However, this is usually not possible due to the above-described inaccuracies of the pressure sensors. The method for calibrating a pressure sensor described in German Published Patent Application No. 195 47 647 confronts this problem by using a reference pressure to calibrate the pressure sensor prior to starting the internal combustion engine. In this instance, the atmospheric pressure may be used, i.e., the ambient pressure prevailing in the system at a standstill and prior to the start of the internal combustion engine. Therefore, a method and a device for calibrating at least one pressure sensor of a fuel metering system of an internal combustion engine are described in German Published Patent Application No. 195 47 647, where the fuel is transported by a pump from a low-pressure region to a high-pressure region and is metered from there by injectors that are controllable as a function of operating parameters into the combustion chambers of the internal combustion engine, the pressure in the high-pressure region and/or in the low-pressure region being measured by the at least one pressure sensor while the internal combustion engine is in operation, and the atmospheric pressure being measured by the pressure sensor prior to the start of the internal combustion engine in order to calibrate the pressure sensor.

However, the conventional method and the conventional device only function properly when the system is already at atmospheric pressure while calibrating the pressure sensors. For this purpose, it may be required to ensure that the internal combustion engine is not operated during a certain standstill time prior to calibration, so that the pressure in the system is able to decrease and to adjust itself to the ambient pressure level.

SUMMARY OF THE INVENTION

An object of the present invention is to propose a method of the species recited at the outset and a corresponding device, which enable the pressure sensor to be calibrated as precisely as possible. This may be achieved in that the cooling-water temperature of the internal combustion engine is measured and the drop in the cooling-water temperature is derived therefrom as a measure for the standstill time of the internal combustion engine, and in that the pressure sensor is first calibrated when the standstill time exceeds a predefinable minimum.

Thus, an arrangment for monitoring the cooling-water temperature already present per se in the vehicle may be used to reliably and precisely calibrate the pressure sensor. Therefore, the present invention is able to be realized very quickly and almost without extra expenses, in particular without using additional timing supervision for measuring the standstill time. Such an exemplary method according to the present invention and the corresponding exemplary device are well suited for calibrating pressure sensors in the high-pressure region (rail pressure sensors) as well as for calibrating sensors in the low-pressure region (presupply pressure sensors).

Accordingly, it may be particularly advantageous when a temperature difference indicating the drop in the cooling-water temperature is determined in that the instantaneous cooling-water temperature is compared to a stored cooling-water temperature previously measured when stopping the internal combustion engine, and the pressure sensor is first calibrated when the temperature difference exceeds a minimum temperature difference corresponding to the predefined minimum. In this context, it may be particularly advantageous when the pressure sensor is calibrated immediately after the control unit of the fuel metering system is initialized. As a result of these measures, the cooling-water temperature only needs to be measured twice, only the cooling-water temperature measured when stopping the engine needing to be stored temporarily until it is compared to the temperature present shortly after the start of the engine.

A particular advantage may also result when the pressure sensor is calibrated in that an atmospheric pressure measured by the pressure sensor during standstill of the internal combustion engine is compared to the absolute value of the atmospheric pressure, the difference between the measured atmospheric pressure and the absolute value indicating a calibration value, which is later applied to the pressure values measured when the internal combustion engine is in operation. The pressure sensor in a diesel rail system has a resolution of measurement of approximately 2 bar. Since the drift may be up to 20 bar, a calibration using 1 bar abs (absolute pressure) is sufficient. However, this is not the case for sensors having a resolution of 1 bar to approximately 6 bar. In this instance, a calibration using the exact atmospheric pressure is desirable since values of 0.01 bar are already important.

In this connection, it may be advantageous when the calibration value is stored in a memory of the control element of the fuel metering system as a stored value until a new calibration value is determined. Therefore, a compensation value for calibrating the pressure sensor is always available.

BRIEF DESCRIPTION OF THE INVENTION

FIG. 1 schematically shows the construction of a device according to the present invention.

Figure 2:
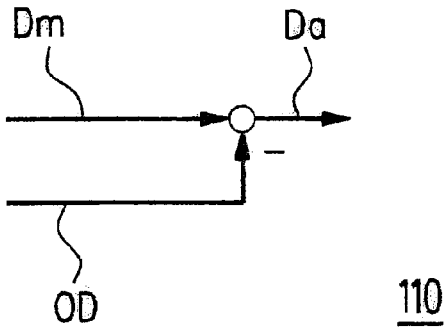

FIG. 2 shows a flow chart for measuring the pressure value.

DETAILED DESCRIPTION

FIG. 1 shows a device 100 of the present invention for calibrating a pressure sensor, which is situated in the high-pressure region of a fuel metering system and supplies a measured value Dm'. The pressure sensor and the fuel metering system are not represented here, since they are conventional. Device 100 shown in FIG. 1 calibrates the pressure sensor in accordance with an exemplary method of the present invention to determine a calibration value OD, also called the compensation value or offset, which is later applied to the measured pressure value. The pressure sensor is calibrated in that pressure value Dm measured prior to the start while the internal combustion engine is at a standstill is compared in a comparator 107 to a setpoint value Dabs for the absolute atmospheric pressure, and in that the difference resulting therefrom is used as new calibration value OD.

According to an exemplary embodiment of the present invention, it is determined by monitoring the cooling-water temperature whether the internal combustion engine has not been operated for a long enough standstill time. If this is the case, a switch 108 is switched and the calibration is performed. However, if this is not the case, switch 108 is not switched, and an earlier stored calibration value ODs is used to compensate the measured value. The decision as to which position switch 108 assumes is controlled by an evaluation circuit described in more detail in the following.

The evaluation circuit essentially checks the temperature drop of the cooling water to determine whether the standstill time is long enough. For this purpose, the evaluation circuit includes a differential element 101, which forms the difference between the instantaneously measured cooling-water temperature Ta and a stored cooling-water temperature Ts, which was previously measured the last time the internal combustion engine was shut off. Temperature difference dT resulting from Ts−Ta is provided to a first comparator 102, which compares this temperature difference to a minimum temperature difference dTu, which is 40 Kelvin, for example. As a result, it is to be determined whether the temperature drop of the cooling water is at least 40 K. The circuit also includes a second comparator 103, which compares instantaneously measured cooling-water temperature Ta to a first lower temperature limiting value T1, which lies, for example, at T1=10° C. Moreover, the circuit includes a third comparator 104, which compares instantaneous cooling-water temperature Ta to a second upper temperature limiting value T2, which lies, for example, at T2=30° C. These comparisons check whether instantaneously measured cooling-water temperature Ta is between upper limiting value T1 and lower limiting value T2. Limiting values T1 and T2 are specified such that they indicate the optimum operating temperature range. The pressure sensor is only to be calibrated when instantaneous temperature Ta is within the allowable range and does not deviate too much from the normal room temperature of 20° C. Most pressure sensors are optimized for this operating temperature.

The outputs of comparators 103 and 104 are supplied to a logical AND circuit 106, which then emits a positive logical signal when instantaneous cooling-water temperature Ta is between 10° C. and 30° C. This logical output signal is supplied to a next AND circuit 105 together with the output signal of first comparator 102. As such, it is not only checked whether instantaneous cooling-water temperature Ta is within the predefined temperature range between 10 and 30° C. but also whether determined temperature drop dT is greater than predefined minimum difference dTu. If all of these conditions are met, AND circuit 105 emits a positive signal that controls circuit 108 so that the pressure sensor is calibrated as previously described.

In accordance with the flow chart shown in FIG. 2, new determined calibration value OD is joined in a differential stage with values Dm measured by the pressure sensor. In each case, calibration value OD is subtracted from measured value Dm, thereby resulting in a corrected instantaneous pressure sensor value Da. This value then represents the value actually measured during operation of the internal combustion engine.

The exemplary embodiment introduced here for a method according to the present invention as well as for a device functioning according thereto are described for the case that a rail pressure sensor situated in the high-pressure region of the fuel metering system is calibrated. However, the present invention is also well suitable for other pressure sensors, in particular for presupply pressure sensors located in the low-pressure region of a fuel metering system. Therefore, the present invention may be used equally for the high-pressure as well as for the low-pressure region.

What is claimed is:

1. A method for calibrating at least one pressure sensor of a fuel metering system of an internal combustion engine, comprising:

transporting a fuel by a pump from a low-pressure region to a high-pressure region;

metering the fuel from the high-pressure region by injectors that are controllable as a function of operating parameters into combustion chambers of the internal combustion engine;

measuring a pressure in at least one of the high-pressure region and the low-pressure region by the at least one pressure sensor while the internal combustion engine is in operation;

measuring an atmospheric pressure by the at least one pressure sensor prior to a start of the internal combustion engine in order to calibrate the at least one pressure sensor;

determining a cooling-water temperature of the internal combustion engine;

deriving from the cooling-water temperature a cooling-water temperature drop as a measure for a standstill time of the internal combustion engine; and calibrating the at least one pressure sensor for a first time when the standstill time exceeds a predefinable minimum.

2. The method according to claim 1, further comprising:

determining a temperature difference indicating the cooling-water temperature drop in that the cooling-water temperature is compared to a stored cooling-water temperature, wherein the at least one pressure sensor is first calibrated when the temperature difference exceeds a minimum temperature difference corresponding to the predefinable minimum.

3. The method according to claim 1, wherein the at least one pressure sensor is calibrated immediately after a control unit of the fuel metering system is initialized.

4. The method according to claim 1, further comprising:

comparing the atmospheric pressure measured by the at least one pressure sensor when the internal combustion engine is at a standstill to a setpoint value for an absolute atmospheric pressure, a difference between the measured atmospheric pressure and the setpoint value indicating a calibration value; and applying the calibration value at a later time to pressure values measured while the internal combustion engine is in operation.

5. The method according to claim 4, further comprising:

storing the calibration value in a memory of a control element of the fuel metering system as a stored value until a new calibration value is determined.

6. A device for calibrating at least one pressure sensor of a fuel metering system of an internal combustion engine, comprising:

a pump to transport a fuel from a low-pressure region to a high-pressure region; injectors that are controllable as a function of operating parameters and configured to meter the fuel into combustion chambers of the internal combustion engine, the at least one pressure sensor configured to measure a pressure in at least one of the high-pressure region and the low-pressure region while the internal combustion engine is in operation;

an arrangement for calibrating the at least one pressure sensor prior to a start of the internal combustion engine using an atmospheric pressure measured by the pressure sensor;

an arrangement for measuring a cooling-water temperature of the internal combustion engine and deriving a cooling-water temperature drop therefrom as a measure for a standstill time of the internal combustion engine; and an arrangement for calibrating the pressure sensor for a first time when the standstill time exceeds a predefinable minimum.

7. A control element for a fuel metering system of an internal combustion engine, comprising:

a device for calibrating at least one pressure sensor of the fuel metering system, the device including:

a pump to transport a fuel from a low-pressure region to a high-pressure region, injectors that are controllable as a function of operating parameters and configured to meter the fuel into combustion chambers of the internal combustion engine, the at least one pressure sensor configured to measure a pressure in at least one of the high-pressure region and the low-pressure region while the internal combustion engine is in operation, an arrangement for calibrating the at least one pressure sensor prior to a start of the internal combustion engine using an atmospheric pressure measured by the pressure sensor, an arrangement for measuring a cooling-water temperature of the internal combustion engine and deriving a cooling-water temperature drop therefrom as a measure for a standstill time of the internal combustion engine, and an arrangement for calibrating the at least one pressure sensor for a first time when the standstill time exceeds a predefinable minimum.

8. A fuel metering system for an internal combustion engine, comprising:

a device for calibrating at least one pressure sensor of the fuel metering system, the device including:

a pump to transport a fuel from a low-pressure region to a high-pressure region, injectors that are controllable as a function of operating parameters and configured to meter the fuel into combustion chambers of the internal combustion engine, the at least one pressure sensor configured to measure a pressure in at least one of the high-pressure region and the low-pressure region while the internal combustion engine is in operation, an arrangement for calibrating the at least one pressure sensor prior to a start of the internal combustion engine using an atmospheric pressure measured by the pressure sensor, an arrangement for measuring a cooling-water temperature of the internal combustion engine and deriving a cooling-water temperature drop therefrom as a measure for a standstill time of the internal combustion engine, and an arrangement for calibrating the at least one pressure sensor for a first time when the standstill time exceeds a predefinable minimum.

* * * * *